US010024056B2

(12) United States Patent
Pacione et al.

(10) Patent No.: US 10,024,056 B2
(45) Date of Patent: Jul. 17, 2018

(54) METHODS AND SYSTEMS FOR ENGAGEMENT OF DECORATIVE COVERING

(75) Inventors: John Anthony Pacione, Newmarket (CA); Joseph Rocco Pacione, Newmarket (CA)

(73) Assignee: TAC-FAST GEORGIA L.L.C., Atlanta, GA (US)

( * ) Notice: Subject to any disclaimer, the term of this patent is extended or adjusted under 35 U.S.C. 154(b) by 328 days.

(21) Appl. No.: 13/447,875

(22) Filed: Apr. 16, 2012

(65) Prior Publication Data

US 2013/0097834 A1 Apr. 25, 2013

Related U.S. Application Data

(60) Provisional application No. 61/475,990, filed on Apr. 15, 2011.

(51) Int. Cl.

| | |
|---|---|
| ***B21D 39/03*** | (2006.01) |
| ***E04F 13/00*** | (2006.01) |
| ***E04F 15/00*** | (2006.01) |
| ***E04F 15/22*** | (2006.01) |
| ***E04C 2/00*** | (2006.01) |
| ***E04C 2/20*** | (2006.01) |
| ***E04F 15/02*** | (2006.01) |
| *B23P 11/00* | (2006.01) |

(52) U.S. Cl.

CPC ..... *E04C 2/00* (2013.01); *E04C 2/20* (2013.01); *E04F 15/02016* (2013.01); *E04F 15/02183* (2013.01); *E04F 15/02194* (2013.01); *Y10T 29/4973* (2015.01); *Y10T 29/4987* (2015.01); *Y10T 29/49947* (2015.01)

(58) Field of Classification Search

CPC ..... E04C 2/00; E04C 2/20
USPC ..... 29/428, 446; 52/311.1, 403.1, DIG. 13
See application file for complete search history.

(56) References Cited

U.S. PATENT DOCUMENTS

| | | | |
|---|---|---|---|
| 644,138 | A | 2/1900 | Ketchum |
| D644,138 | S | 2/1900 | Kethcum |
| 652,716 | A | 6/1900 | Furness |
| D652,716 | S | 6/1900 | Furness |
| 748,746 | A | 1/1904 | Kelsey |
| D748,746 | S | 1/1904 | Kelsey |
| 1,673,630 | A | 6/1928 | Madge |

(Continued)

FOREIGN PATENT DOCUMENTS

| | | |
|---|---|---|
| AU | 4092672 | 5/1977 |
| BE | 853033 | 7/1977 |

(Continued)

OTHER PUBLICATIONS

United States Patent and Trade Mark Office: Office Action dated May 27, 2016, in respect of related U.S. Appl. No. 13/446,634; 8 pages.

(Continued)

*Primary Examiner* — Sarang Afzali
*Assistant Examiner* — Darrell C Ford
(74) *Attorney, Agent, or Firm* — Christopher N. Hunter; Norton Rose Fulbright Canada LLP

(57) ABSTRACT

Kits and methods for installing, repairing and/or replacing a decorative covering on a non-decorative substrate. The kit may include an engagement layer, a decorative covering and/or a substrate.

2 Claims, 9 Drawing Sheets

(56) References Cited

U.S. PATENT DOCUMENTS 1,929,871 A 10/1933 Jones
2,012,929 A 8/1935 Knowland
2,114,450 A 4/1938 MacLean
2,735,523 A 2/1956 Leyerle et al.
3,002,868 A 10/1961 Boivin
3,031,730 A 5/1962 Morin
3,147,528 A 9/1964 Erb
3,247,638 A 4/1966 Gay, Jr.
3,583,057 A 6/1969 Kolozsvary
3,522,637 A 8/1970 Brumlik
3,574,019 A 4/1971 Girard
3,649,424 A * 3/1972 Rhiando Maxwell ..... 428/45
3,708,833 A 1/1973 Ribich
3,711,349 A 1/1973 Snyder et al.
3,712,845 A 1/1973 Hartung
3,735,988 A 5/1973 Palmer
3,775,856 A 5/1973 Schmidt
3,817,015 A 6/1974 Frangos
3,866,267 A 2/1975 Poletti
4,361,311 A * 11/1982 Koroyasu ..... A47G 27/0493 173/117
4,405,668 A * 9/1983 Wald ..... 428/41.8
4,430,837 A 2/1984 Kirschenbaum
4,489,115 A 12/1984 Layman et al.
4,528,783 A 7/1985 Muir
4,557,774 A * 12/1985 Hoopengardner ..... 156/71
4,577,448 A 3/1986 Haworth
4,578,910 A 4/1986 Germeroth et al.
4,638,618 A 1/1987 Iesaka et al.
4,649,069 A 3/1987 Tone
4,671,976 A 6/1987 Vidal
4,673,603 A 6/1987 Roth
4,697,294 A 10/1987 Schafer
4,744,194 A 5/1988 Yasuyoshi
4,755,401 A 7/1988 Friedrich
4,766,022 A 8/1988 Tone
4,769,895 A 9/1988 Parkins
4,770,917 A 9/1988 Tochacek
4,810,546 A 3/1989 McLaughlin
4,822,658 A 4/1989 Pacione
4,824,498 A 4/1989 Goodwin et al.
4,825,477 A 5/1989 Aranda
4,829,627 A 5/1989 Altus et al.
4,797,170 A 10/1989 Hoopengardner
4,898,417 A 2/1990 Kudo
4,898,493 A 2/1990 Blankenburg
4,922,670 A 5/1990 Naka et al.
4,968,548 A 11/1990 Gibson et al.
4,974,384 A 12/1990 Pacione
4,996,804 A 3/1991 Naka et al.
5,042,221 A 8/1991 Pacione
5,045,389 A 9/1991 Campagna
5,060,443 A 10/1991 Pacione
5,116,439 A 5/1992 Raus
5,133,166 A 7/1992 Pacione
5,144,786 A 9/1992 Pacione
5,149,573 A 9/1992 Kobe et al.
5,191,692 A 3/1993 Pacione
5,200,245 A 4/1993 Broderick, Jr.
5,259,163 A 11/1993 Pacione
5,333,423 A 8/1994 Propst
5,382,462 A 1/1995 Pacione
5,386,670 A 2/1995 Takeda et al.
5,398,347 A 3/1995 Luedtke et al.
5,479,755 A 1/1996 Pacione
5,482,755 A * 1/1996 Manning ..... 428/95
5,529,825 A 6/1996 Sutherland
5,537,793 A * 7/1996 Murasaki ..... 52/585.1
5,654,066 A 8/1997 Pacione
5,672,404 A * 9/1997 Callahan et al. ..... 428/100
5,691,026 A 11/1997 Linke et al.
5,691,027 A * 11/1997 Eckhardt et al. ..... 428/100
5,693,171 A 12/1997 Foster
5,723,195 A 3/1998 Pacione
5,753,336 A * 5/1998 Stull ..... 428/86
5,804,273 A 9/1998 Drake, Jr. et al.
5,832,619 A 9/1998 Volkema, Jr.
5,863,637 A 1/1999 Mansson et al.
5,879,777 A * 3/1999 Shipley ..... 428/100
5,888,114 A * 3/1999 Slocum et al. ..... 446/128
5,902,663 A 5/1999 Justensen et al.
5,965,232 A 10/1999 Vinod
5,980,230 A 11/1999 Dowd et al.
6,083,596 A 7/2000 Pacione
6,093,469 A * 7/2000 Callas ..... 428/95
6,158,185 A 12/2000 Counihun
6,182,414 B1 2/2001 Huang
6,199,328 B1 3/2001 McGrath et al.
6,203,881 B1 3/2001 Higgins
6,217,974 B1 * 4/2001 Pacione ..... 428/95
6,250,001 B1 6/2001 Gillespie
6,286,272 B1 9/2001 Sandoz
6,298,624 B1 * 10/2001 Pacione ..... 52/511
6,306,477 B1 10/2001 Pacione
6,395,362 B1 5/2002 Pacione
6,460,303 B1 * 10/2002 Pacione ..... 52/311.2
6,463,871 B1 * 10/2002 Anderson et al. ..... 114/357
6,526,704 B1 3/2003 Berard et al.
6,599,599 B1 7/2003 Buckwater et al.
6,631,598 B2 * 10/2003 Raineri ..... 52/385
6,662,518 B1 * 12/2003 Devereux ..... A47G 27/045 16/16
6,797,353 B1 9/2004 Pacione
6,802,167 B2 * 10/2004 Pacione ..... 52/506.05
6,855,221 B1 * 2/2005 Lepsius et al. ..... 156/71
7,096,632 B2 8/2006 Pacione
7,185,465 B2 3/2007 Pacione
7,185,473 B2 3/2007 Pacione
7,194,843 B2 3/2007 Pacione
7,341,773 B1 * 3/2008 Schulte ..... 428/95
7,383,663 B2 6/2008 Pacione
7,412,806 B2 8/2008 Pacione
7,517,426 B2 * 4/2009 Mano et al. ..... 156/304.4
7,614,332 B2 11/2009 Pacione
7,841,151 B2 * 11/2010 Uhlig ..... 52/741.1
7,879,168 B2 2/2011 Pacione
7,919,034 B2 4/2011 Pacione
7,980,040 B2 7/2011 Pacione
8,468,770 B2 * 6/2013 McDonald ..... B32B 27/12 428/86
8,691,360 B2 4/2014 Pacione
8,894,794 B2 * 11/2014 Balmer et al. ..... 156/248
9,060,631 B2 6/2015 Pacione
2001/0017017 A1 8/2001 Pacione
2002/0009568 A1 * 1/2002 Bries et al. ..... 428/40.1
2004/0020159 A1 2/2004 Nelson
2005/0166372 A1 * 8/2005 Shepard et al. ..... 24/442
2006/0003141 A1 1/2006 Pacione
2006/0057328 A1 3/2006 Pacione
2006/0144014 A1 * 7/2006 Yoon et al. ..... 52/784.1
2006/0162269 A1 7/2006 Pacione
2006/0191218 A1 8/2006 Pacione
2007/0079557 A1 4/2007 Pacione
2007/0079572 A1 4/2007 Pacione
2007/0193169 A1 * 8/2007 Emblin ..... 52/426
2007/0204428 A1 9/2007 Pacione
2007/0204556 A1 9/2007 Pacione
2007/0289238 A1 12/2007 Payne et al.
2008/0008861 A1 * 1/2008 Leng ..... 428/156
2008/0135159 A1 * 6/2008 Bries et al. ..... 156/160
2008/0172968 A1 7/2008 Pacione
2008/0202672 A1 * 8/2008 Bradford ..... 156/210
2008/0282632 A1 * 11/2008 Sleeman ..... 52/309.1
2009/0029083 A1 * 1/2009 Endo ..... 428/36.5
2009/0038251 A1 2/2009 Pacione
2009/0068439 A1 * 3/2009 Callahan et al. ..... 428/319.7
2009/0095943 A1 * 4/2009 Thompson ..... A47G 27/0493 254/212
2009/0133354 A1 * 5/2009 Spear et al. ..... 52/588.1
2009/0252918 A1 * 10/2009 van Der Mark ..... 428/116
2009/0282759 A1 * 11/2009 Porter ..... 52/220.1
2010/0236180 A1 9/2010 Pacione
2011/0117803 A1 * 5/2011 Barzilai ..... 442/1
2011/0185670 A1 * 8/2011 Mitchell et al. ..... 52/539

(56) References Cited

U.S. PATENT DOCUMENTS

| | | | | |
|---|---|---|---|---|
| 2011/0239566 | A1* | 10/2011 | Ciuperca et al. | 52/259 |
| 2012/0042594 | A1* | 2/2012 | Studnicka | 52/302.1 |
| 2013/0067855 | A1* | 3/2013 | Perez | 52/750 |
| 2013/0086861 | A1* | 4/2013 | Masanek et al. | 52/309.1 |
| 2013/0097833 | A1 | 4/2013 | Pacione | |
| 2013/0097834 | A1* | 4/2013 | Pacione et al. | 29/402.08 |
| 2013/0298486 | A1* | 11/2013 | Conterno | 52/309.1 |
| 2014/0059961 | A1* | 3/2014 | Yin et al. | 52/426 |
| 2014/0113117 | A1* | 4/2014 | Buehne | 428/207 |
| 2014/0260032 | A1* | 9/2014 | Rainey | E04F 15/02 52/311.1 |
| 2015/0168619 | A1* | 6/2015 | Ohmoto et al. | 359/359 |
| 2016/0032597 | A1* | 2/2016 | Keane | E04F 15/18 52/309.9 |
| 2016/0273222 | A1* | 9/2016 | Yonebayashi | B62D 25/00 |

FOREIGN PATENT DOCUMENTS

| | | | |
|---|---|---|---|
| CA | 2 375 141 | A1 | 12/2000 |
| DE | 7029524 | | 11/1970 |
| DE | 2012523 | | 2/1972 |
| DE | 2201231 | | 7/1973 |
| DE | 2245915 | | 4/1974 |
| DE | 2803006 | | 8/1979 |
| DE | 4228597 | | 3/1994 |
| DE | 19532685 | | 3/1997 |
| DE | 19724698 | | 12/1998 |
| EP | 0161637 | | 11/1985 |
| EP | 0455926 | | 11/1991 |
| EP | 0860543 | | 8/1998 |
| EP | 1514498 | A1 | 3/2005 |
| EP | 2436515 | A1 | 4/2012 |
| FR | 2328432 | | 5/1977 |
| FR | 2362257 | | 3/1978 |
| FR | 2582210 | | 11/1986 |
| FR | 2747605 | | 10/1997 |
| GB | 11747 | | 6/1892 |
| GB | 1204886 | | 9/1970 |
| GB | 1376262 | | 12/1974 |
| GB | 1546901 | | 5/1979 |
| JP | 5256725 | | 5/1977 |
| JP | 5374719 | | 7/1978 |
| JP | 5711279 | | 1/1982 |
| JP | 5981479 | | 6/1984 |
| JP | 61187582 | | 11/1986 |
| JP | 288015 | | 3/1990 |
| JP | 232151 | | 8/1990 |
| JP | 08-326279 | | 12/1996 |
| JP | 09-209555 | | 8/1997 |
| JP | 10118988 | | 5/1998 |
| JP | 10-219975 | | 8/1998 |
| JP | 10216962 | | 8/1998 |
| WO | 8601247 | | 2/1986 |
| WO | 9503723 | | 2/1995 |
| WO | 9519242 | | 7/1995 |
| WO | 9803104 | | 1/1998 |
| WO | 9830381 | | 7/1998 |
| WO | 09/35943 | A2 | 7/1999 |
| WO | 9935943 | | 7/1999 |
| WO | 9935944 | | 7/1999 |
| WO | 0060974 | | 10/2000 |
| WO | 0181771 | | 11/2001 |

OTHER PUBLICATIONS

United States Patent and Trade Mark Office: Office Action dated Oct. 14, 2015, in respect of related U.S. Appl. No. 13/446,634; 8 pages.

United States Patent and Trade Mark Office: Office Action dated Mar. 30, 2015 ,in respect of related U.S. Appl. No. 13/446,634; 6 pages.

United States Patent and Trade Mark Office: Office Action dated Sep. 4, 2014 in respect of related U.S. Appl. No. 13/446,634; 8 pages.

United States Patent and Trade Mark Office: Office Action dated Mar. 9, 2017, in respect of related U.S. Appl. No. 13/446,634; 12 pages.

InterfaceFLOR, Spring Catalog, 2006, pp. 1-56, Canada.

* cited by examiner

METHODS AND SYSTEMS FOR ENGAGEMENT OF DECORATIVE COVERING

CROSS-REFERENCE TO RELATED APPLICATIONS

The present disclosure claims priority from U.S. provisional patent application No. 61/475,990 filed Apr. 15, 2011, the entirety of which is hereby incorporated by reference.

FIELD OF TECHNOLOGY

The present disclosure relates to methods and systems for engagement of decorative coverings to a non-decorative substrate. In particular, the present disclosure relates to engagement layers to facilitate engagement of decorative coverings to a non-decorative substrate. The present disclosure also relates to methods for engaging a decorative covering onto a non-decorative substrate and repair of a decorative covering, using engagement layers.

BACKGROUND

Decorative coverings (e.g., made of ceramic, stone, granite, marble, porcelain, woven material, polymer, vinyl material or vinyl-like material) may be engaged or installed on a non-decorative substrate using permanent or non-permanent engagement systems. Such non-decorative substrates may be in turn supported by a base surface (e.g., floor, wall or ceiling). In some examples, it may be useful to use decorative coverings intended for permanent engagement systems (e.g., pressure-sensitive adhesive) with a non-permanent engagement system (e.g., hook-and-loop fasteners or interlocking protrusions). Conversion of a decorative covering intended for a permanent engagement system to be used for a non-permanent engagement system may be costly and/or time-consuming, and/or may require stocking double inventory.

Relatively rigid and/or relatively brittle decorative coverings (e.g., ceramic, stone, granite, marble, porcelain, glass or tiles) may be prone to cracking or breaking, for example when bearing heavy weight or subjected to high forces. Such cracking or breaking may be undesirable, for example it may be aesthetically unpleasing, noisy, prone to chipping, and/or dangerous to users.

In some examples, water seepage between a decorative covering and the substrate may be undesirable. For example, water seepage may cause weakening of the engagement between the decorative covering and the substrate.

DETAILED DESCRIPTION

Figure 1:
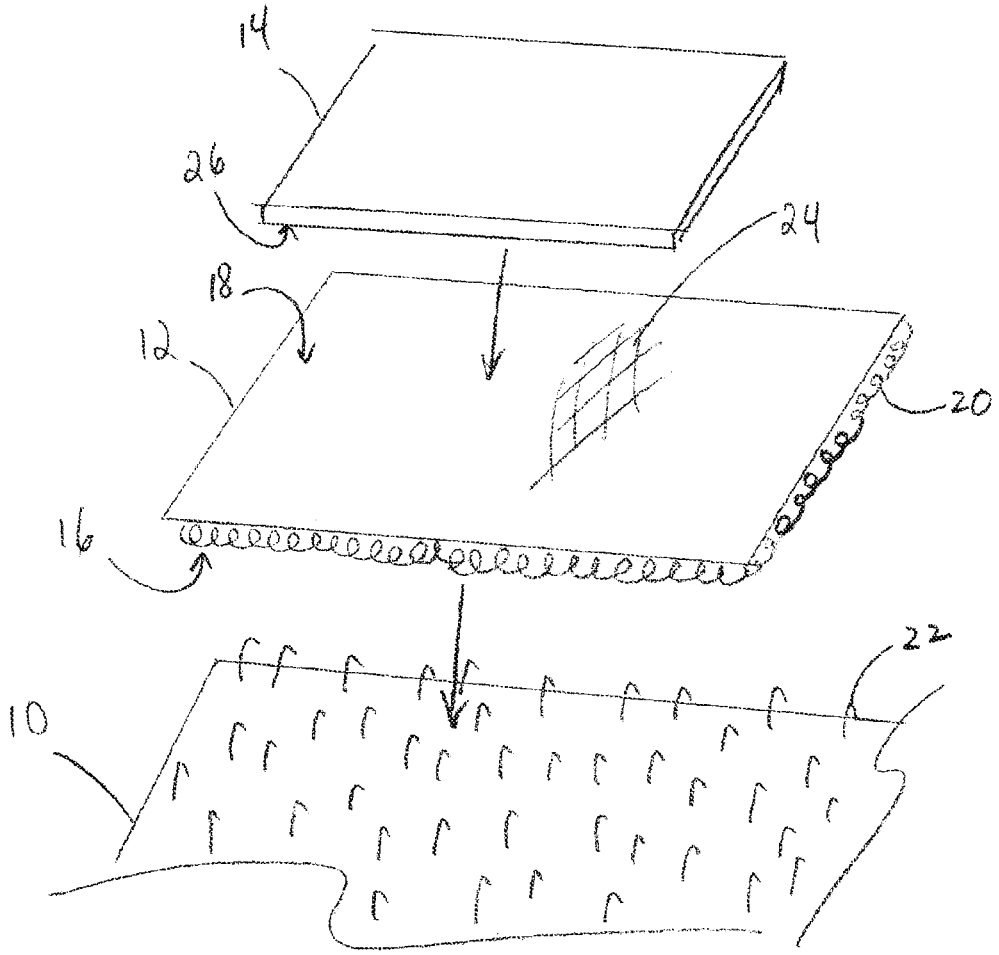
FIG. 1 illustrates an example system for engagement of a decorative covering to a non-decorative substrate.

The engagement layer, and associated methods and systems disclosed herein may be useful for facilitating engagement of a decorative covering to a non-decorative substrate. The engagement layer, and associated methods and systems, may also be useful for repair of a decorative covering on a non-decorative substrate.

In this disclosure, engagement of two pieces may refer to permanent or non-permanent attachment of the pieces together, close contact between the two pieces, and/or fixation or immobilization of the two pieces relative to each other.

In this disclosure, a decorative covering may refer to any covering that is intended to be seen, while a non-decorative substrate may refer to any substrate that is intended to be unseen.

In some example aspects, the present disclosure provides a kit for installing a decorative covering to a non-decorative substrate, the kit may include: an engagement layer including a covering-receiving side and an opposing substrate-receiving side, wherein at least a portion of the substrate-receiving side has a first component of a first engagement system that is complementary to a second component of the first engagement system provided on the non-decorative substrate; and the decorative covering, wherein the decorative covering has an engagement side for engagement to the covering-receiving side of the engagement layer; wherein at least a portion of at least one of the engagement side of the decorative covering and the covering-receiving side of the engagement layer may include a second engagement system for engaging the decorative covering to the engagement layer.

In some examples, the kit may include a predetermined number of decorative coverings and engagement layers sufficient to cover a base surface.

In some examples, the kit may include at least one of: a closable container and a shrink wrap for holding the engagement layer and the decorative covering.

In some examples, the engagement layer may be sized to match the decorative covering and/or the substrate, and/or may be shaped and sized in some other convenient configuration to facilitate attachment.

In some examples, the kit may include the substrate, the substrate being free of attachments to a base surface.

In some examples, the first engagement system may include at least one of: a hook-and-loop system, a hook-and-hook system, a tongue-and-groove system, an interlocking system, a plurality of protrusions, a detachable adhesive and a permanent adhesive.

In some examples, the first and second components of the first engagement system may be substantially similar.

In some examples, the engagement layer may include an auxiliary engagement system on at least a portion of the substrate-receiving side, the auxiliary engagement system covering a smaller portion of the substrate-receiving side than the first component of the first engagement system, the auxiliary engagement system being capable of forming a stronger engagement with the substrate than the first engagement system.

In some examples, the engagement layer may include at least one of: a woven material, a non-woven material, a fabric, a polymer and a metal.

In some examples, the second engagement system may include at least one of: a permanent adhesive and a detachable adhesive.

In some examples, the permanent adhesive may be a cement.

In some examples, the detachable adhesive may include at least one of: a pressure-sensitive adhesive and a liquid adhesive.

In some examples, a removable protective covering may be provided over the adhesive.

In some examples, the engagement layer may be larger in size than the decorative covering.

In some examples, the engagement layer may be sized to allow for engagement of a plurality of decorative coverings.

In some examples, the engagement layer may include a reinforcement layer for increasing rigidity of the engagement layer.

In some examples, the reinforcement layer may include at least one of: fibreglass, film, polymer, metal, and a non-woven material.

In some examples, the engagement layer may include a cushioning layer for providing resiliency to the engagement layer.

In some examples, the cushioning layer may include at least one of: a woven material, a polymer material, a fleece material and a foam material.

In some examples, the engagement layer may include at least one of: a cushioning layer, a reinforcement layer, a sound absorbing layer, and a thickening layer.

In some examples, the decorative covering may include at least one of: vinyl, luxury vinyl tile (LVT), vinyl-like material, carpet, wood, tile, ceramic, stone, granite, polymer, marble, porcelain, glass, clay, a relatively rigid material and a relatively brittle material.

In some example aspects, the present disclosure provides a kit for installing an engagement layer to a non-decorative substrate, the kit may include: the engagement layer including a covering-receiving side and an opposing substrate-receiving side, wherein at least a portion of the substrate-receiving side has a first component of a first engagement system that is complementary to a second component of the first engagement system provided on the non-decorative substrate; and the substrate including an engagement side and an opposing base-facing side, wherein at least a portion of the engagement side may include the second component of the first engagement system.

In some examples, the engagement layer may include an auxiliary engagement system on at least a portion of the substrate-receiving side, the auxiliary engagement system covering a smaller portion of the substrate-receiving side than the first component of the first engagement system, the auxiliary engagement system being capable of forming a stronger engagement with the substrate than the first engagement system.

In some examples, the engagement layer may be sized to match the substrate.

In some examples, the engagement layer and the substrate may be provided already engaged to each other.

In some example aspects, the present disclosure provides a method for engaging a decorative covering to a non-decorative substrate, the method may include: applying an engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system; and applying the decorative covering to the applied engagement layer, the decorative covering having an engagement side for engagement to the covering-receiving side of the engagement layer; wherein at least a portion of at least one of the engagement side of the decorative covering and the covering-receiving side of the engagement layer may include a second engagement system for engaging the decorative covering to the engagement layer.

In some examples, the method may include placing the substrate on a base surface, the substrate being free of attachment to the base surface.

In some examples, the method may include engaging at least a portion of the perimeter of the engagement layer to a perimeter of an adjacent engagement layer.

In some example aspects, the present disclosure provides a method for repairing or replacing a decorative covering on a non-decorative substrate, the method may include: wherein the decorative covering may be engaged to the non-decorative substrate by an engagement layer, the engagement layer having a covering-receiving side and an opposing substrate-receiving side, at least a portion of the substrate-receiving side having a first component of a first engagement system, the non-decorative substrate having a second component of the first engagement system; wherein at least a portion of at least one of the engagement side of the decorative covering and the covering-receiving side of the engagement layer may include a second engagement system for engaging the decorative covering to the engagement layer; removing at least a portion of the decorative covering to be repaired and at least a portion of an engagement layer corresponding to the removed portion of the decorative covering from the non-decorative substrate; engaging a new engagement layer portion to the non-decorative substrate; and engaging a new decorative covering portion to the new engagement layer portion.

In some example aspects, the present disclosure provides a method for engaging a decorative covering to a non-decorative substrate, the method may include: applying an engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system, the first and second components forming a resilient bond; applying the decorative covering to the engagement layer, the decorative covering having an engagement side for engagement to the covering-receiving side of the engagement layer; wherein at least a portion of at least one of the engagement side of the decorative covering and the covering-receiving side of the engagement layer may include a second engagement system for engaging the decorative covering to the engagement layer; applying a grouting product along at least a portion of the perimeter of the applied decorative covering, wherein applying the grouting product includes displacing the engagement layer at least in a direction parallel to the non-decorative substrate, in order to stretch the resilient bond; and wherein the decorative covering may be biased against the grouting product by the stretched resilient bond.

In some example aspects, the present disclosure provides a method for engaging a decorative covering to a non-decorative substrate, the method may include: applying an engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system, the first and second components forming a resilient bond; applying the decorative covering to the engagement layer, the decorative covering having an engagement side for engagement to the covering-receiving side of the engagement layer; wherein the decorative covering may include a grouting product along at least a portion of the perimeter of the decorative covering; and wherein at least a portion of at least one of the engagement side of the decorative covering and the covering-receiving side of the engagement layer may include a second engagement system for engaging the decorative covering to the engagement layer; and displacing the engagement layer at least in a direction parallel to the non-decorative substrate, in order to stretch the resilient bond; wherein a side of the grouting product opposing the decorative covering may be pressed against a surface, to maintain the displacement of the engagement layer, wherein the decorative covering is biased against the grouting product by the stretched resilient bond.

In some example aspects, the present disclosure provides a method for engaging a decorative covering to a non-decorative substrate, the method may include: applying a compressible engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system, the first and second components forming a resilient bond; applying the decorative covering to the engagement layer, the decorative covering having an engagement side for engagement to the covering-receiving side of the engagement layer; wherein at least a portion of at least one of the engagement side of the decorative covering and the covering-receiving side of the engagement layer may include a second engagement system for engaging the decorative covering to the engagement layer; applying a force to the decorative covering to compress at least a portion of the engagement layer engaged with the decorative covering, to bring the decorative covering substantially level with an adjacent surface; and applying a grouting product along at least a portion of the perimeter of the applied decorative covering, between the decorative covering and the adjacent surface; wherein the grouting product may engage the decorative covering and the adjacent surface to maintain the decorative covering substantially level with the adjacent surface.

In some examples, the grouting product may include a grout strip including an adhesive for engaging the decorative covering and the adjacent surface.

FIG. 1 illustrates an example system for engaging a decorative covering to a non-decorative substrate. In this example, a non-decorative substrate 10, an engagement layer 12 and a decorative covering 14 are shown. The engagement layer 12 may have a substrate-receiving side 16 for placing on the substrate 10 and an opposite covering-receiving side 18 on which the decorative covering 14 may be placed. The decorative covering 14 may have an engagement side 26 for engagement to the engagement layer 12.

The decorative covering 14 may be made of any suitable material including, for example, carpet, a woven material, tile, wood, ceramic, stone, granite, marble, porcelain, clay, glass, polymer, vinyl, luxury vinyl tile (LVT), a vinyl-like material, or any other suitable material.

The engagement layer 12 may be made of any suitable material including, for example, woven material, non-woven material, fabric, polymer, metal, or any other suitable material. In some examples, the engagement layer 12 may include one or more sub-layers, such as a reinforcement layer and/or a cushioning layer, as will be described further below.

Although not shown, in some examples the substrate 10 may be a layer provided over a base (e.g., a base floor, a base wall or a base ceiling). In some examples, the substrate 10 may be free of attachments (e.g., free-floating) to the base surface or may be permanently or non-permanently attached to the base surface (e.g., with fasteners, adhesives, etc.). Where the substrate 10 is free of attachments to the base surface, the substrate 10 may be designed to minimize shifting or movement, for example the substrate 10 may be sufficiently heavy to avoid shifting. In some examples, the substrate 10 may include multiple components, such as complementary plate(s) and disc(s). In some examples, the substrate 10 may be the base itself.

In this example, at least a portion (in some examples, a major portion or all) of the substrate-receiving side 16 of the engagement layer 12 may include a first component of a first engagement system that cooperates with a complementary second component of the first engagement system on at least a portion (in some examples, a major portion or all) of the substrate 10. In this example, the first engagement system may be a hook-and-loop engagement system, the first component provided on the substrate-receiving side 16 of the engagement layer 12 may be a plurality of loops 20, and the second component provided on the substrate 10 may be a plurality of hooks 22.

In this example, at least a portion (in some examples, a major portion or all) of the covering-receiving side 18 of the engagement layer 12 may include a second engagement system, in this example an adhesive 24, for engaging the decorative covering 14 to the engagement layer 18. The engagement side 26 of the decorative covering 14 may be suitably configured to be receptive to the adhesive 24, for example the engagement side 26 may be substantially smooth and may be made of a material that is receptive to the adhesive 24.

Although in this example the second engagement system (in this case, the adhesive 24) is shown provided on the covering-receiving side 18 of the engagement layer 12, in other examples the second engagement system may be alternatively or additionally provided on at least a portion of the engagement side 26 of the decorative covering 14.

In some examples, the first engagement system may be any suitable detachable engagement system (e.g., hook-and-loop system, hook-and-hook system, tongue-and-groove system, interlocking system, detachable adhesive, etc.), which may have one component or two complementary components. In some examples, the first engagement system may only have one component, which may be provided on the substrate-receiving side 16 of the engagement layer 12 and/or the substrate 10.

In some examples, the second engagement system may be any suitable permanent engagement system (e.g., adhesive, cement, etc.) or any suitable detachable engagement system (e.g., hook-and-loop system, hook-and-hook system, tongue-and-groove system, interlocking system, detachable adhesive, etc.). Where an adhesive 24 is used, the adhesive 24 may be any suitable adhesive, including, for example, pressure sensitive adhesives or liquid adhesives. Where the adhesive 24 comprises a liquid adhesive, the liquid adhesive may be allowed to partially dry or set (i.e., to "tackify") before installation engaging the decorative covering 14.

In some examples, other engagement systems may be used in place of those described above.

In some examples, the engagement layer 12 may be larger in size than the decorative covering 14, and may be used to engage with two or more decorative coverings 14. For example, the engagement layer 12 may be relatively flexible and may be provided as a roll (e.g., as a fabric roll). The engagement layer 12 may then be rolled out over the substrate 10, with the substrate-receiving side 16 towards the substrate 10. The decorative covering 14 may then be engaged to the covering-receiving side 18 of the engagement layer 12.

In some examples, the engagement layer 12 may be sized to match at least one dimension (e.g., length or width) of the decorative covering 14 and/or the substrate 10, and/or may be shaped and sized in some other convenient geometry to facilitate attachment. For example, the engagement layer 12 may be substantially the same shape and size as the decorative covering 14 and/or the substrate 10.

In some examples, the substrate 10 may be provided with the engagement layer 12 already engaged on the substrate 10 and aligned such that the perimeter of the engagement layer 12 substantially matches the perimeter of the substrate 10, or is contained within or overlaps with the boundaries of the substrate 10. Alternatively, the substrate 10 may be first laid down and the engagement layer 12 subsequently positioned and aligned on the substrate 10. In addition to the first engagement system (e.g., hook-and-loop system) between the engagement layer 12 and the substrate 10, there may additionally be an auxiliary engagement system (e.g., a non-permanent adhesive, such as a hot melt glue) provided in at least a portion of the contact between the engagement layer 12 and the substrate 10. The auxiliary engagement system may help to maintain the engagement layer 12 engaged and aligned on the substrate 10, for example when positioning the decorative covering 14 on the engagement layer 12.

For example, when positioning the decorative covering 14 on the engagement layer 12, the decorative covering 14 may need to be re-positioned on the engagement layer 12. The second engagement system (e.g., an adhesive, such as a pressure-sensitive adhesive) may engage between the decorative covering 14 and the engagement layer 12 before the decorative covering 14 may be properly positioned, and disengagement of the decorative covering 14 from the engagement layer 12 (e.g., by peeling the decorative covering 14 from the engagement layer 12) may unintentionally also disengage at least a portion of the engagement layer 12 from the substrate 10. The auxiliary engagement system between the engagement layer 12 and the substrate 10 may help to reduce or avoid such unintentional disengagement (e.g., the auxiliary engagement system may form stronger engagements than the first engagement system). The auxiliary engagement system may be provided only in a portion of the contact between the engagement layer 12 and the substrate 10 (e.g., only in corner areas of the engagement layer 12 and/or in internal areas) such that intentional disengagement of the engagement layer 12 from the substrate 10 (e.g., by intentional peeling of the engagement layer 12 off the substrate 10) may be done manually.

However, the auxiliary engagement system may ultimately be disengaged, for example when a decorative covering 14 is removed and/or replaced, and the engagement layer 12, or portion thereof, is removed and/or replaced. For example, a non- or slow-hardening glue (e.g., a hot melt glue, such as used for attaching plastic credit cards to paper during shipping) may be used as the auxiliary engagement system.

In some examples, the substrate 10 may be provided to the consumer with the engagement layer 12 already engaged on the substrate 10 via the first engagement system and the auxiliary engagement system. The engagement layer 12 in such a case may be shaped and sized to match the substrate 10. The engagement layer 12 may be provided with a protective covering (not shown) over the second engagement layer (e.g., an adhesive 24). The protective covering may include perforations and/or tabs to assist in removal of the protective covering by the consumer, and may be peeled off manually.

Regardless of the relative dimensions of the engagement layer 12 and the decorative covering 14, engagement of the decorative covering 14 to the engagement layer 12 need not be on a one-to-one basis and need not line up the sides of the decorative covering 14 and the engagement layer 12. For example, even where the engagement layer 12 is sized to match the length and width of the decorative covering 14, the decorative covering 14 may be engaged on the engagement layer 12 in a staggered manner, such that one decorative covering 14 bridges two or more adjacent engagement layers 12. Such staggered engagement may be useful to avoid creating a straight seam from the decorative covering 14 down to the substrate 10, and may help to reduce or prevent seepage of moisture or liquid down to the substrate, for example.

In some examples, where an adhesive 24 is used (e.g., on the engagement layer 12 and/or on the decorative covering 14), the adhesive 24 may be already provided (e.g., during manufacturing) and a removable protective covering (not shown) may be provided over the adhesive 24, to protect the adhesive 24 from unintentional adhesion and/or damage before use. The protective covering may be removed when the adhesive 24 is ready for engagement. In some examples, the adhesive 24 may be applied during installation.

In some examples, the engagement layer 12 may be relatively rigid. For example, the covering-receiving side 18 of the engagement layer 12 may include a reinforcement layer 30 (see FIG. 5A) to increase the rigidity of the engagement layer. The reinforcement layer 30 may be a sub-layer of the engagement layer 12. In some examples, the reinforcement layer 30 (which may also be referred to as a stabilization layer) may be made of a film material, fibreglass material, non-woven material, etc. In some examples, the reinforcement layer may be made of a polymer (e.g., PET), a metal (e.g., steel or aluminum) or other relatively rigid material. The reinforcement layer 30 may be useful where the engagement layer 12 is relatively flexible (e.g., a woven material, such as Malimo stitchthrough or tricot) and/or has been weakened, for example by stitching of loops 20.

By providing a relatively rigid engagement layer 12 (e.g., including the use of a reinforcement layer 30), the chances of cracking, fracturing or deformation of the decorative covering 14 may be reduced. For example, where the substrate 10 may have imperfections or unevenness, a relatively rigid engagement layer 12 may help to reduce or avoid translation of such imperfections or unevenness to the decorative covering 14. In some examples, where multiple decorative coverings 14 are applied on a single engagement layer 12, a relatively rigid engagement layer 12 may provide uniform support to all the decorative coverings 14, which may help to reduce or avoid relative displacement or depressing of the decorative coverings 14, such as when a weight is placed on one of the several decorative coverings 14. In some examples, a relatively rigid engagement layer 12 may also be useful to provide support where the decorative covering 14 is cracked or fractured, which may help reduce or avoid the appearance of cracks, the shifting of cracked portions and/or noise of shifting cracked pieces. In some examples, the engagement layer 12 may comprise only the reinforcement layer 30.

Figure 5A:
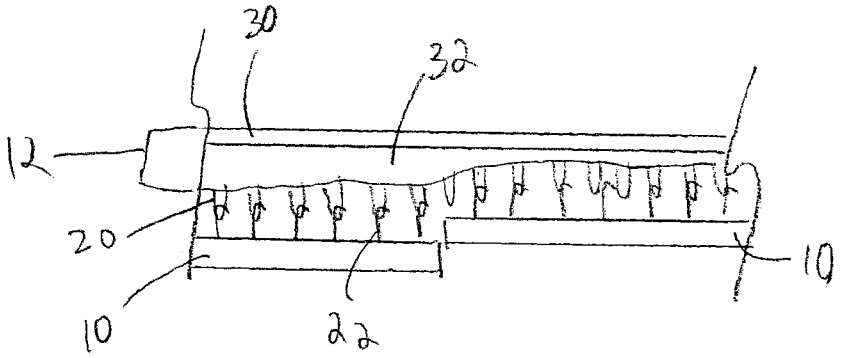
FIGS. 5A and 5B illustrate example systems for engagement of decorative coverings to non-decorative substrates, including an engagement layer having reinforcement and/or cushioning sub-layers.
Figure 5B:
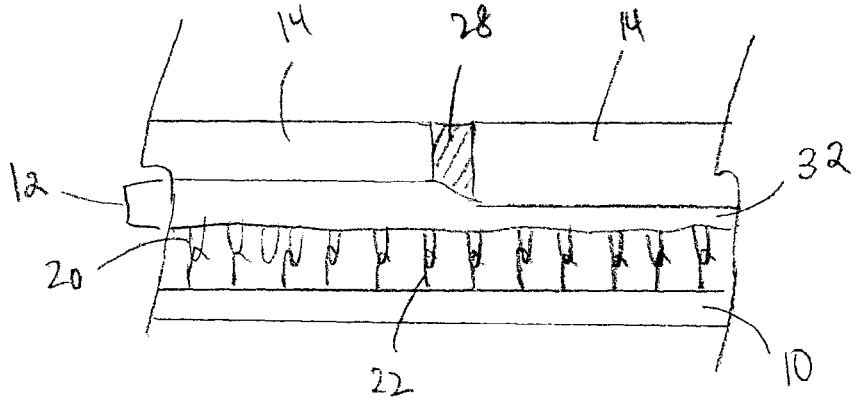

In some examples, the engagement layer 12 may provide some cushioning (e.g., the engagement layer 12 may include a cushioning layer 32, see FIGS. 5A and 5B) between the decorative covering 14 and the substrate 10. For example, the engagement layer 12 may include a woven material, a foam material, a fleece material, a polymer material or other resilient material as the cushioning layer 32. This may allow the engagement layer 12 to accommodate any imperfections and/or unevenness in the substrate 10 and/or the base. In some examples, the cushioning layer 32 may also be useful for providing cushioning for underfoot comfort when walking on the decorative covering 14 (e.g., where the decorative covering 14 is a carpet or is otherwise expected or intended to be soft). In some examples, the cushioning layer 32 may provide sound absorption, for example to muffle or dampen the sound of footsteps on the decorative covering 14 (e.g., to dampen the sound of footsteps on a wooden decorative covering 14). Where the cushioning layer 32 provides sound absorbing properties, the cushioning layer 32 may comprise materials other than cushioning and/or compressible materials (e.g., the cushioning layer 32 may itself comprise two or more sub-layers of different materials, or may comprise a mixture of materials) In some examples, the engagement layer 12 may comprise only the cushioning layer.

For example, as shown in FIG. 5A, where the engagement layer 12 bridges two adjacent substrates 10, there may be a difference in height between the two substrates 10 that may be evened out by the cushioning of the engagement layer 12. For example, the cushioning layer 32 may be more compressed in the region over the higher substrate 10 and less compressed in the region over the lower substrate 10, thereby evening out the height difference. The cushioning capability of the engagement layer 12 may be provided with the reinforcement capability described above (e.g., by including both a cushioning layer 32 and a reinforcement layer 30) to enable the engagement layer 12 to provide a relatively even and rigid surface for supporting the decorative covering 14 while also enabling the engagement layer 12 to accommodate and even out any imperfections and/or unevenness in the substrate 10 and/or the base.

Although the engagement layer 12 has been described as optionally including a reinforcement layer 30 and/or a cushioning layer 32, it should be understood that the engagement layer 12 may include other optional layers such as a sound absorbing layer (e.g., to providing a sound absorbing property), or a thickening layer (e.g., to raise the surface on which decorative coverings 14 may be installed), among others. While different optional layers may each provide different properties to the engagement layer 12, in some examples a single optional layer may provide more than one property to the engagement layer 12 (e.g., a cushioning layer 32 may provide cushioning, sound absorbing and thickening properties).

An example system or kit for engaging the decorative covering 14 to the substrate 10 may include the engagement layer 12 and the decorative covering 14. Where the engagement layer 12 and the decorative covering 14 have different sizes (e.g., where the engagement layer 12 is much larger than the decorative covering 14) the kit may include different multiples of the engagement layer 12 and the decorative covering 14. Where the engagement layer 12 and the decorative covering 14 are substantially the same in size, the kit may include one engagement layer 12 and one decorative covering 14. In some examples, the kit may include a plurality of decorative coverings 14 and/or a plurality of engagement layers 12, sufficient in number to cover an intended surface. In some examples, the kit may include a closable container (e.g., a box) holding the decorative covering(s) 14 and the engagement layer(s) 12. In some examples, the kit may include a shrink wrap enclosing the decorative covering(s) 14 and the engagement layer(s) 12. In some examples, where the substrate 10 is to be placed on a base surface, the kit may include one or more substrate(s) 10. In some examples, the kit may include the substrate(s) 10 and not the decorative covering(s) 14.

Figure 2:
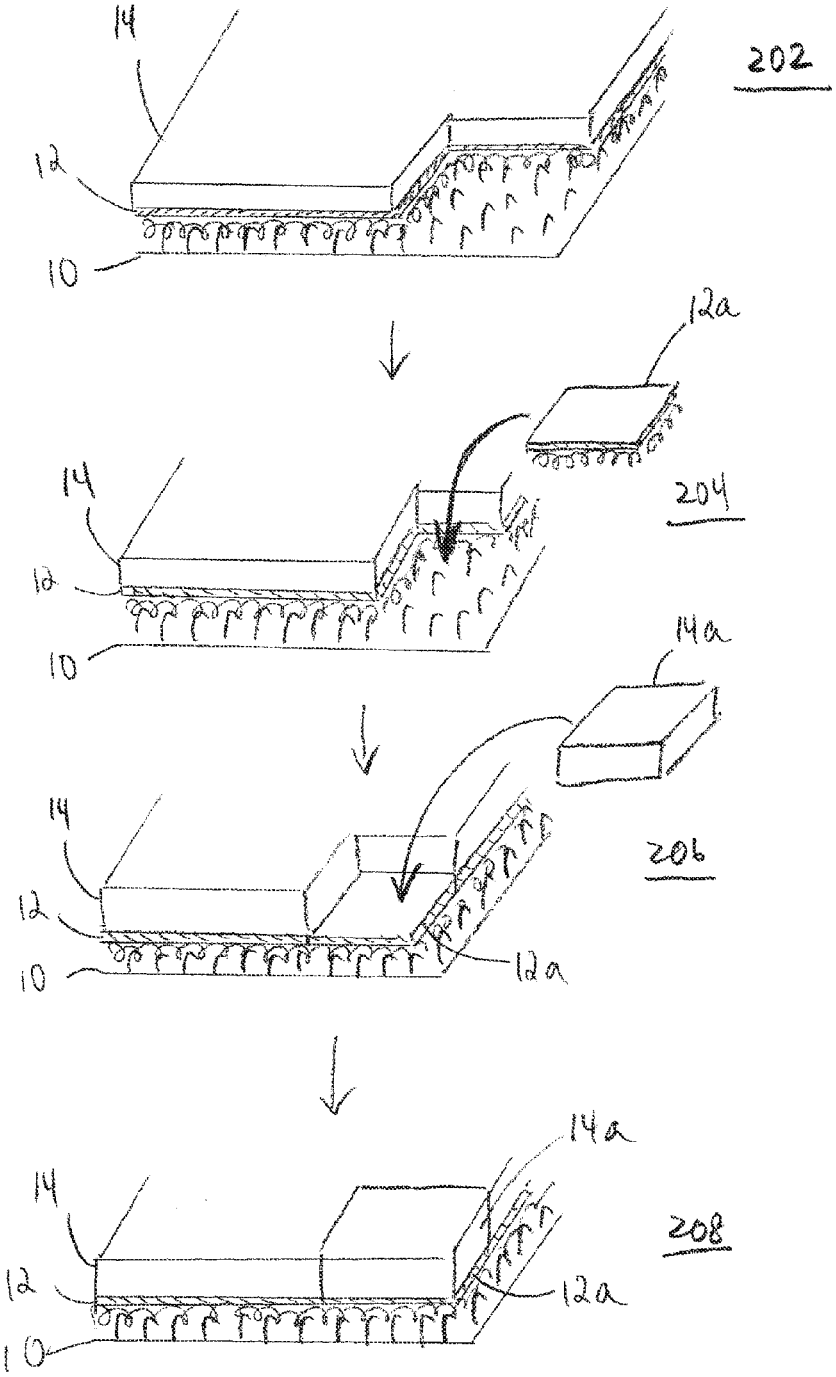
FIG. 2 illustrates an example method for repair of a decorative covering on a non-decorative substrate.

FIG. 2 illustrates an example method for repair of the decorative covering 14. In this example, the decorative covering 14 may be engaged to the substrate 10 using the engagement layer 12, such as described above with respect to FIG. 1. Repair of the decorative covering 14 may be desirable, for example where a portion of the decorative covering 14 has been damaged (e.g., scratched, chipped, cracked, etc.) but replacement of the entire decorative covering 14 is undesirable.

For example, at 202, a portion of the decorative covering 14 and corresponding portion of the engagement layer 12 may be removed from the substrate 10. Removal of the portion of the decorative covering 14 and engagement layer 12 may be facilitated by the detachability of the first engagement system between the engagement layer 12 and the substrate 10. The removed portion may be cut out from the larger piece of engagement layer 12 and decorative covering 14.

At 204, a new portion of engagement layer 12*a* may be applied to the substrate 10. The new portion of engagement layer 12*a* may be, for example, cut from a larger piece of engagement layer 12 or may be provided as part of a repair kit and/or used as-is. In some examples, the new portion of engagement layer 12*a* may be trimmed to fit the portion to be repaired. Although a single new portion of engagement layer 12*a* is shown, repair may require use of more than one new portion of engagement layer 12*a*.

At 206, a new portion of decorative covering 14*a* may be applied to the new portion of engagement layer 12*a*. The new portion of decorative covering 14*a* may be, for example, cut from a larger piece of decorative covering 14 or may be provided as part of a repair kit and/or used as-is. In some examples, the new portion of decorative covering 14*a* may be trimmed to fit the portion to be repaired. Although a single new portion of decorative covering 14*a* is shown, repair may require use of more than one new portion of decorative covering 14*a*.

At 208, repair of the decorative covering 14 may be complete. Further steps may include, for example, applying grout, applying a polish, applying a seam sealer, sanding or buffing, to improve the appearance of the repair and/or to ensure a tight seam between the new portion of decorative covering 14*a* and the remaining decorative covering 14.

Figure 3A:
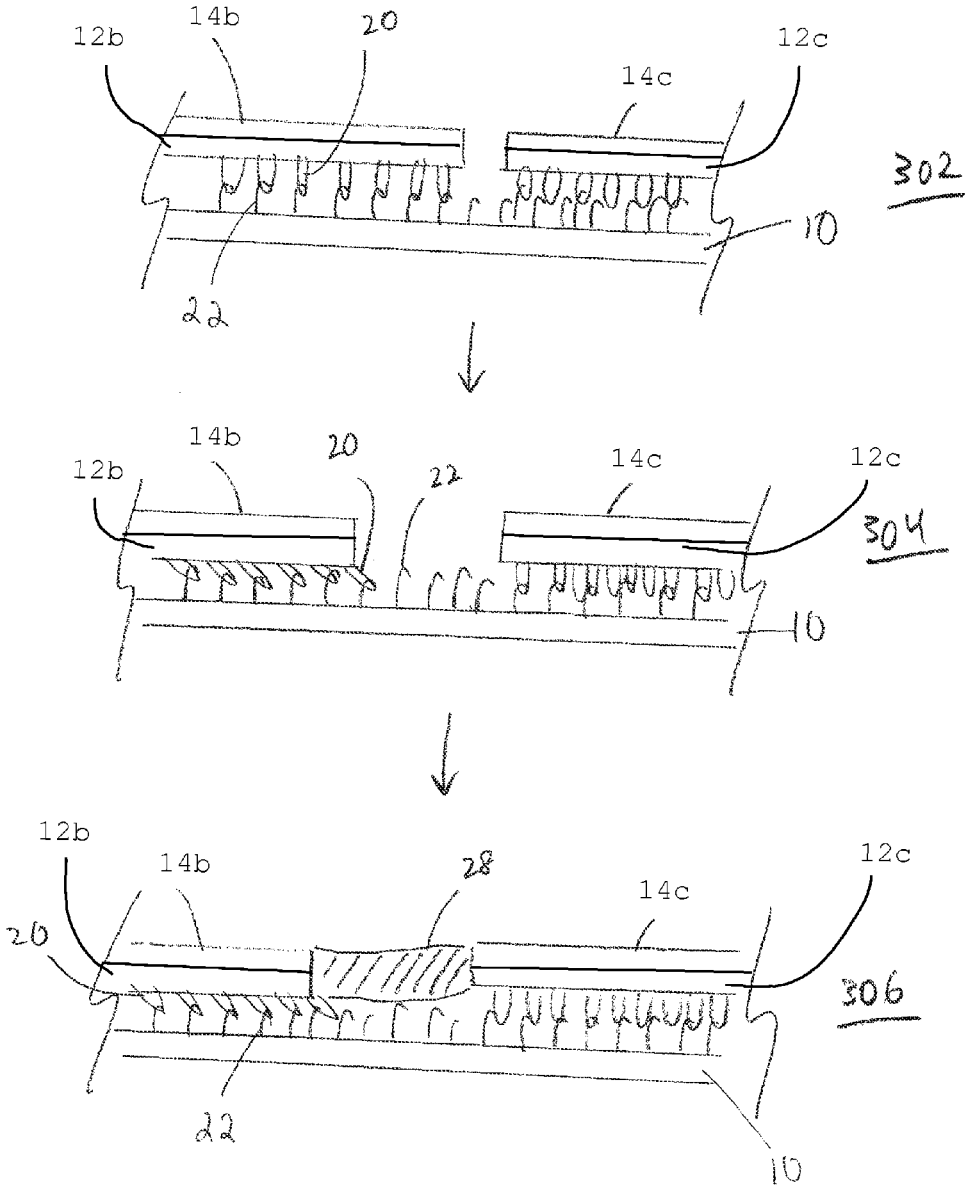
FIGS. 3A-3D illustrate example methods of installing a decorative covering on a non-decorative substrate, using grout.
Figure 3B:
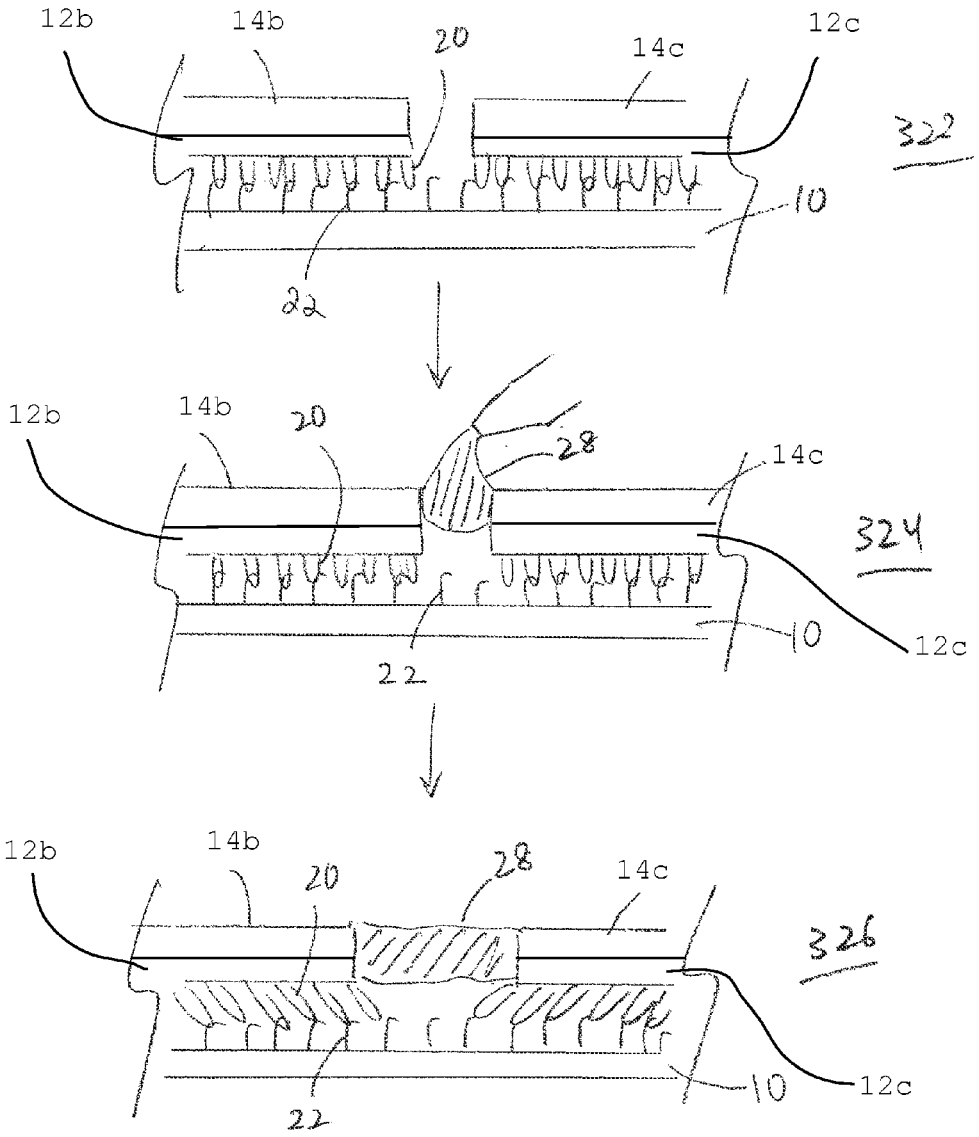

In some examples, a grouting product may be used with the decorative covering 14, such as where the decorative covering 14 is a tile, or is made of ceramic, stone, granite, marble, porcelain or clay. FIGS. 3A and 3B illustrate examples of the use of grout in engaging a decorative covering 14 to a non-decorative substrate 10. The grout may be a compressible (e.g., a polymer, such as polypropylene or polyvinyl chloride) or non-compressible, elastic, resilient, liquid or non-liquid product. For example, the grout may be a strip of compressible and elastic material that is fitted between adjacent decorative coverings 14. The use of grout may help to ensure a water-tight seal between adjacent decorative coverings 14, which may help to ensure little or no moisture seepage under the decorative coverings 14. The use of grout may also help to maintain the position of adjacent decorative coverings 14 relative to each other, to reduce or avoid shifting of the decorative coverings 14 and/or to reduce or avoid differences in height between adjacent decorative coverings 14.

For example, as shown in FIG. 5B, where the engagement layer 12 has a cushioning capability (e.g., including a cushioning layer 32), a first decorative covering 14 that is positioned higher than a second adjacent decorative covering 14 may be pressed down, compressing the engagement layer 12 immediately under the first decorative covering 14, and a grout map be applied between the first and second decorative coverings 14 in order to keep the surfaces of the first and second decorative coverings 14 substantially even. There may be engagement systems (e.g., an adhesive, such as a pressure-sensitive adhesive) between the grout and the sides of the decorative coverings 14 and/or between the decorative coverings 14 and the engagement layer 12 in order to keep the decorative coverings 14 in place after pressing down. For example, the grout may be a grout strip including an adhesive (e.g., a pressure-sensitive adhesive) along two opposing sides of its length, to engage with the sides of the decorative coverings 14 and keep the first decorative covering 14 substantially even with the second decorative covering 14, or the grout may be a liquid or semi-solid grout applied between the decorative coverings 14 that, when set, bonds to the sides of the decorative coverings 14 to hold the decorative coverings 14 substantially even with each other.

In FIG. 3A, two adjacent engagement layers 12*b*, 12*c* are engaged to the substrate 10, each of the engagement layers 12*b*, 12*c* may support a respective decorative covering 14*b*, 14*c*. The decorative coverings 14*b*, 14*c* may be engaged to the respective engagement layers 12*b*, 12*c* using any suitable engagement system, for example an adhesive. In this example, a hook-and-loop system is used for engaging the engagement layers 12*b*, 12*c* to the substrate 10, with the hooks 22 being provided on the substrate 10 and the loops 20 being provided on the substrate-receiving side of the engagement layers 12*b*, 12*c*.

As shown in 302, the engagement layers 12*b*, 12*c* and respective decorative coverings 14*b*, 14*c* may be positioned adjacent to each other with a gap in between.

At 304, the gap may be widened, for example by displacing one or both of the decorative coverings 14*b*, 14*c* (and hence the respective engagement layers 12*b*, 12*c*) away from each other, in a direction that may be at least partially substantially parallel to the substrate 10 (e.g., sideways). In this example, the engagement system between the engagement layers 12*b*, 12*c* and the substrate 10 (in this case, a hook-and-loop system) may have stretchable bonds, such that widening of the gap causes the bonds to be stretched (in this case, the loops 20 of the engagement layer 12*b* are stretched). The gap may be widened to allow for grout to be applied between the decorative coverings 14*b*, 14*c*.

At 306, grout 28 has been applied between the decorative coverings 14*b*, 14*c*. In the example shown, the grout 28 may be applied between the engagement layers 12*b*, 12*c*, however in other examples the grout 28 may be applied only between the decorative coverings 14*b*, 14*c* and not the engagement layers 12*b*, 12*c* (e.g., where the grout 28 is applied in an amount that does not reach the engagement layers 12*b*, 12*c*). The grout 28 may be of a consistency sufficient to reduce or avoid permeation of the grout 28 onto the substrate 10. For example, the grout 28 may be a sufficiently thick liquid to avoid permeating onto the substrate 10. In another example, the grout 28 may be non-liquid, such as a polymer (e.g., rubber) strip. In this example, the grout 28 may be sufficiently incompressible so as to maintain the widened distance between the engagement layers 12*b*, 12*c* and decorative coverings 14*b*, 14*c*. Because the engagement layer 12*b* has stretched bonds with the substrate 10, its respective decorative covering 14*b* is thus biased towards the grout 28. This biasing may help to ensure a tight seal between the decorative coverings 14*b*, 14*c* and the grout 28 (and also between the engagement layers 12*b*, 12*c* and the grout 28 where the grout 28 may be applied between the engagement layers 12*b*, 12*c*), which may help to reduce or avoid seepage of water or other liquids or moisture between the decorative coverings 14*b*, 14*c* and the substrate 10.

In FIG. 3B, two adjacent engagement layers 12*b*, 12*c* and respective decorative coverings 14*b*, 14*c* are engaged to the substrate 10. In this example, a hook-and-loop system is used for engaging the engagement layers 12*b*, 12*c* to the substrate 10, with the hooks 22 being provided on the substrate 10 and the loops 20 being provided on the substrate-receiving side of the engagement layers 12*b*, 12*c*.

As shown in 322, the engagement layers 12*b*, 12*c* and decorative coverings 14*b*, 14*c* may be positioned adjacent to each other with a gap in between. In this example, the engagement system between the engagement layers 12*b*, 12*c* and the substrate 10 (in this case, a hook-and-loop system) may have stretchable bonds, such that widening of the gap causes the bonds to be stretched (in this case, the loops 20 of the engagement layer 12*b* are stretched).

At 324, grout 28 may be applied in the gap between the decorative coverings 14*b*, 14*c*. In the example shown, the grout 28 is also applied between the engagement layers 12*b*, 12*c*, however in other examples the grout 28 may be applied only between the decorative coverings 14*b*, 14*c* and not the engagement layers 12*b*, 12*c* (e.g., where the grout 28 is applied in an amount that may not reach the engagement layers 12*b*, 12*c*). The grout 28 may be of a consistency sufficient to reduce or avoid permeation of the grout 28 onto the substrate 10. The grout 28 may be liquid or non-liquid. Where the grout 28 is liquid, the grout 28 may be sufficiently thick to avoid permeating onto the substrate 10.

At 326, the gap has been filled with grout 28. In this example, the grout 28 may be sufficiently incompressible and/or rigid so as to widen the gap between the engagement layers 12*b*, 12*c* and the decorative coverings 14*b*, 14*c*, thus displacing the decorative coverings 14*b*, 14*c* and hence the engagement layers 12*b*, 12*c* in a direction at least partially substantially parallel to the substrate 10 (e.g., sideways), thereby stretching the bonds between the engagement layers 12*b*, 12*c* and the substrate 10 (in this case, by stretching the loops 20). For example, the grout 28 may be non-liquid, such as a polymer (e.g., rubber) strip that may be forced between the decorative coverings 14*b*, 14*c*. The stretching of the bonds between the engagements layers 12*b*, 12*c* and the substrate 10 may cause the engagement layers 12*b*, 12*c* and the decorative coverings 14*b*, 14*c* to be biased towards each other. This biasing may help to ensure a tight seal between the decorative coverings 14*b*, 14*c* and the grout 28 (and also between the engagement layers 12*b*, 12*c* and the grout 28 where the grout 28 is also applied between the engagement layers 12*b*, 12*c*), which may help to reduce or avoid seepage of water or other liquids between the decorative coverings 14*b*, 14*c* and the substrate 10.

Although FIGS. 3A and 3B show the engagement layers 12*b*, 12*c* already engaged with respective decorative coverings 14*b*, 14*c*, in some examples the application of grout 28 may take place before engaging the decorative coverings 14*b*, 14*c* onto the engagement layers 12*b*, 12*c*. For example, the grout 28 may be applied between the engagement layers 12*b*, 12*c* in the manner described above and the decorative coverings 14*b*, 14*c* may be subsequently engaged onto the engagement layers 12*b*, 12*c*.

Figure 3C:
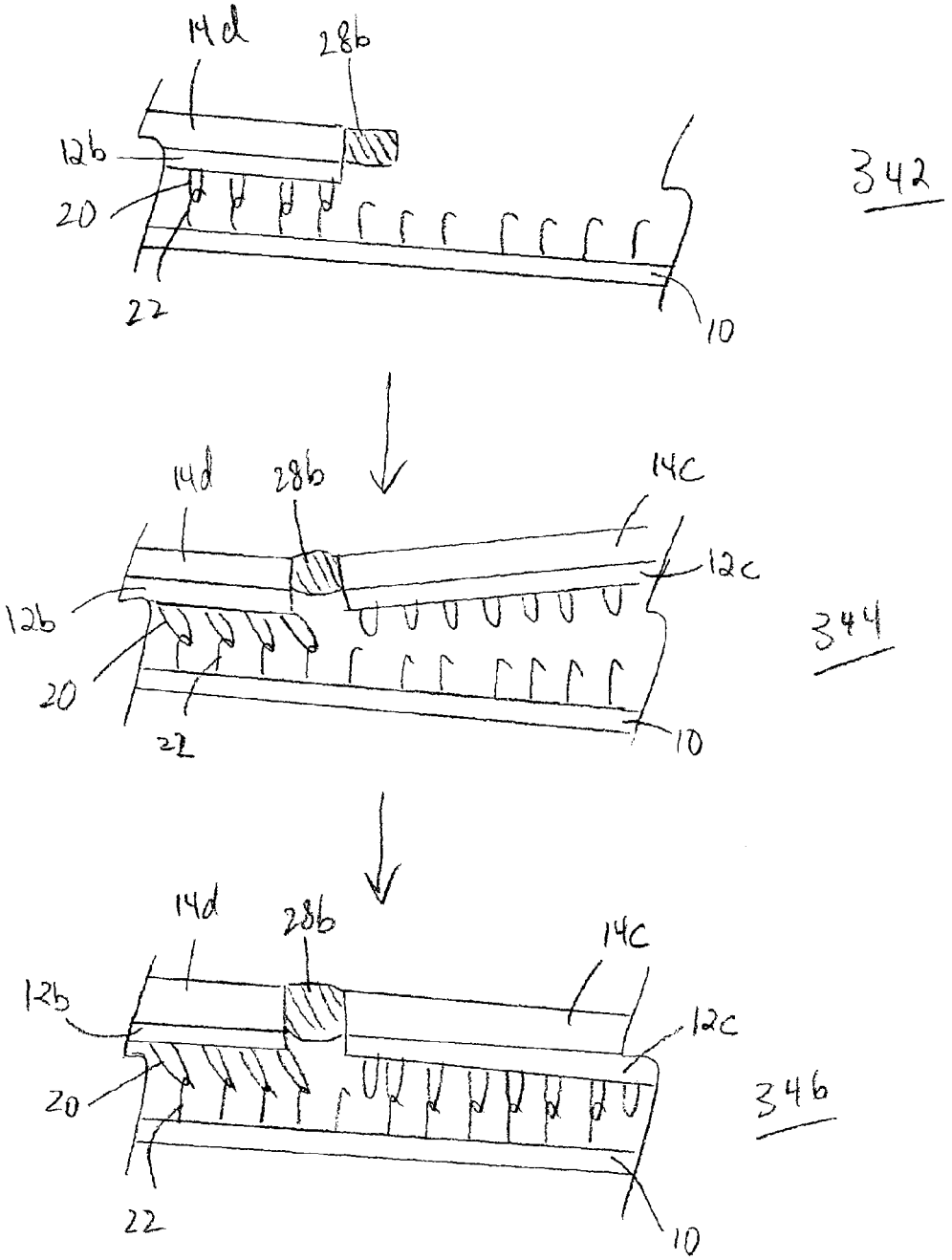
Figure 3D:
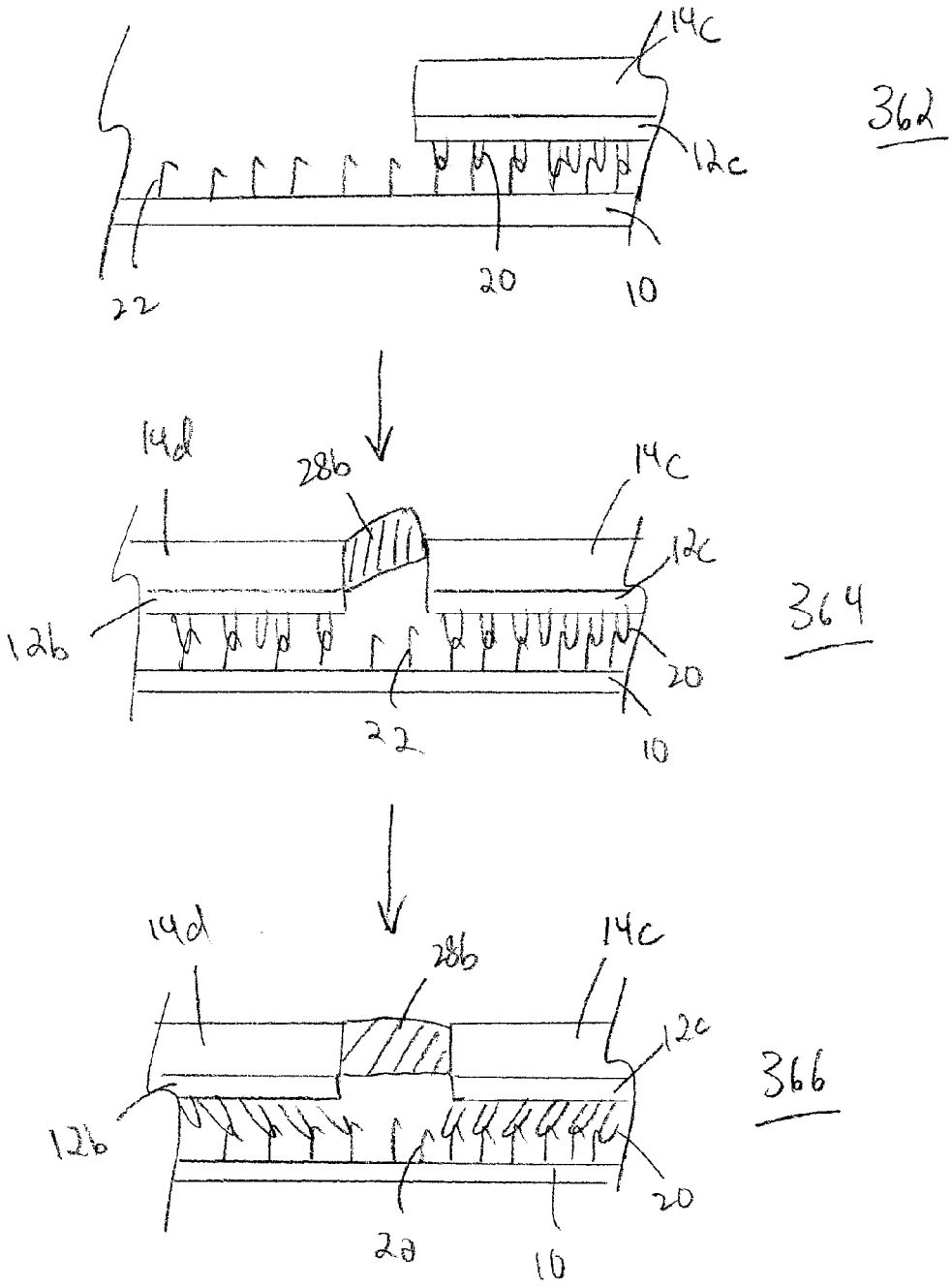

FIGS. 3C and 3D illustrate other examples of the use of grout in engaging a decorative covering 14 to a non-decorative substrate 10. In these examples, a decorative covering 14*d* may include a pre-applied grout 28*b* along at least a portion of its perimeter (e.g., along at least the length of one peripheral side). The grout 28*b* may be a compressible or non-compressible, elastic or resilient product. The grout 28*b* may be pre-applied during manufacturing of the decorative covering 14*d* or may be pre-applied (e.g., by a consumer or end-user) just prior to engaging the decorative covering 14*d* onto the engagement layer 12*b*. For example, the grout 28*b* may be a strip of compressible and elastic material that is pre-applied to at least a portion of the perimeter of the decorative covering 14*d* during manufacture of the decorative covering 14*d*. It may be useful to pre-apply the grout 28*b* to the decorative covering 14*d* during manufacture, in order to simplify the installation of the decorative covering 14*d* by the consumer, for example.

For example, the grout 28*b* may be provided as a strip that may be applied to at least a portion of the perimeter of the decorative covering 14*d* (e.g., during manufacturing or by the consumer), for example using an adhesive (e.g., a pressure-sensitive adhesive) provided along the length of the strip. In another example, the grout 28*b* may be applied as a liquid or semi-liquid to at least a portion of the perimeter of the decorative covering 14*d* and allowed to set.

In FIG. 3C, the engagement layer 12*b* is engaged to the substrate 10 and supports a decorative covering 14*d* having pre-applied grout 28*b*. An adjacent engagement layer 12*c* may support a decorative covering 14*c* that does not include pre-applied grout 28*b*, or another decorative covering including pre-applied grout 28*b*. The decorative coverings 14*c*, 14*d* may be engaged to the engagement layers 12*b*, 12*c* using any suitable engagement system, for example an adhesive. In this example, a hook-and-loop system may be used for engaging the engagement layer 12*b*, 12*c* to the substrate 10, with the hooks 22 being provided on the substrate 10 and the loops 20 being provided on the substrate-receiving side of the engagement layer 12*b*, 12*c*.

As shown in 342, the engagement layer 12*b* may be engaged to the substrate 10 and supporting the decorative covering 14*d*.

At 344, another engagement layer 12*c* and decorative covering 14*c* may be positioned against the engagement layer 12*b* and decorative covering 14*d* by pressing at least a portion of the perimeter of at least the decorative covering 14*c* against at least a portion of the grout 28*b*. Where the grout 28*b* is compressible, this may at least partially compress the grout 28*b*. The application of the decorative covering 14*c* against the grout 28*b* of the decorative covering 14*d* may cause displacement of the decorative covering 14*d* (and hence the engagement layer 12*b*) in a direction at least partially substantially parallel to the substrate 10 (e.g., sideways). In this example, the engagement system between the engagement layer 12*b* and the substrate 10 (in this case, a hook-and-loop system) may have stretchable bonds, such that displacement of the engagement layer 12*b* causes the bonds to be stretched (in this case, the loops 20 of the engagement layer 12*b* are stretched).

At 346, the engagement layer 12*c* is engaged to the substrate 10. In this example, the grout 28*b* may be sufficiently incompressible so as to maintain the displacement of the engagement layer 12*b* and decorative covering 14*d*. Because the engagement layer 12*b* has stretched bonds with the substrate 10, its respective decorative covering 14*d* and grout 28*b* is thus biased towards the decorative covering 14*c*. This biasing may help to ensure a tight seal between the decorative coverings 14*b*, 14*c* and the grout 28*b*, which may help to reduce or avoid seepage of water or other liquids or moisture between the decorative coverings 14*b*, 14*c* and the substrate 10.

Although FIG. 3C illustrates the decorative covering 14*d* being engaged to the engagement layer 12*b* and being first laid down on the substrate 10, in other examples the decorative covering 14*d* may be engaged to the engagement layer 12*c* and being subsequently positioned against another decorative covering already laid down on the substrate 10, in a manner similar to that described above.

In FIG. 3D, the engagement layer 12*c* is engaged to the substrate 10 and supports a decorative covering 14*c* not having pre-applied grout 28*b*. An adjacent engagement layer 12*b* may support a decorative covering 14*d* that does include pre-applied grout 28*b*. The decorative coverings 14*c*, 14*d* may be engaged to the engagement layers 12*b*, 12*c* using any suitable engagement system, for example an adhesive. In this example, a hook-and-loop system is used for engaging the engagement layer 12*b*, 12*c* to the substrate 10, with the hooks 22 being provided on the substrate 10 and the loops 20 being provided on the substrate-receiving side of the engagement layer 12*b*, 12*c*.

As shown in 362, the engagement layer 12*c* may be engaged to the substrate 10 and may be supporting the decorative covering 14*c*.

At 364, another engagement layer 12*b* and decorative covering 14*d* may be positioned adjacent to the engagement layer 12*c* and decorative covering 14*c* with the portion of the perimeter of the decorative covering 14*d* having pre-applied grout 28*b* being positioned adjacent the decorative covering 14*c* with a spacing less than the uncompressed dimension of the pre-applied grout 18*b*. This may cause the pre-applied grout 28*b* to bow out, bend up or otherwise protrude from the space between the adjacent decorative coverings 14*c*, 14*d*.

At 366, the protruding pre-applied grout 28*b* may be pressed (e.g., manually or with the aid of a tool such as a stick) into the space between the adjacent decorative coverings 14*c*, 14*d*. Where the grout 28*b* is at least partially compressible, this may at least partially compress the grout 28*b*. Pressing the grout 28*b* in between the adjacent decorative coverings 14*c*, 14*d* may cause the decorative coverings 14*c*, 14*d* to be pushed apart by the grout 28*b*, thereby resulting in displacement of the engagement layers 12*b*, 12*c*, in a direction at least partially substantially parallel to the substrate 10 (e.g., sideways). In this example, the engagement system between the engagement layers 12*b*, 12*c* and the substrate 10 (in this case, a hook-and-loop system) may have stretchable bonds, such that displacement of the engagement layers 12*b*, 12*c* causes the bonds to be stretched (in this case, the loops 20 of the engagement layers 12*b*, 12*c* are stretched).

The grout 28*b* may be sufficiently incompressible so as to maintain the displacement of the engagement layers 12*b*, 12*c* and decorative coverings 14*c*, 14*d*. Because the engagement layers 12*b*, 12*c* have stretched bonds with the substrate 10, their respective decorative coverings 14*c*, 14*d* are thus biased towards each other and the grout 28*b*. This biasing may help to ensure a tight seal between the decorative coverings 14*c*, 14*d* and the grout 28*b*, which may help to reduce or avoid seepage of water or other liquids or moisture between the decorative coverings 14*c*, 14*d* and the substrate 10.

Although the examples of FIGS. 3A-3D illustrate installation of a decorative covering 14*b*, 14*c*, 14*d* against an adjacent decorative covering 14*b*, 14*c*, 14*d*, in other examples a similar manner of installation may be used for installing the decorative covering 14*b*, 14*c*, 14*d* adjacent to any other surface (e.g., a wall).

In some examples, two decorative coverings 14*d* including pre-applied grout 28*b* may be positioned adjacent to each other, for example with the side of one decorative covering 14*d* having pre-applied grout 28*b* being positioned against the side of another decorative covering 14*d* free of pre-applied grout 28*b*, such that a tight seal may be formed between the pre-applied grout 28*b* of one decorative covering 14*d* and a grout-free side of the other decorative covering 14*d*. In other examples, the respective pre-applied grout 28*b* of two adjacent decorative coverings 14*d* may be positioned against each other, such that a tight seal may be formed between the pre-applied grout 28*b* of one decorative covering 14*d* and the pre-applied grout 28*b* of the other decorative covering 14*d*.

In some examples, the grout 28 may engage or bond with the sides of the decorative coverings 14*b*, 14*c* (e.g., a liquid grout 28, when set, may bond with the decorative coverings 14*b*, 14*c*; a non-liquid grout 28 may include an adhesive to engage the decorative coverings 14*b*, 14*c*) to help form a liquid-tight seal and/or to help reduce relative motion of the installed decorative coverings 14*b*, 14*c*. Similarly, the free side of the pre-applied grout 28*b* may engage the side of the adjacent decorative covering 14*c* (e.g., using an adhesive, such as a pressure-sensitive adhesive) to help form a liquid-tight seal and/or to help reduce relative motion of the installed decorative coverings 14*c*, 14*d*.

In some examples, adjacent engagement layers 12*b*, 12*c* may be engaged to each other (e.g., by application of a grout 28, by adhesives such as adhesive bead, or by welding) to help reduce or avoid seepage of water or other liquids to the substrate 10. Engaging adjacent engagement layers 12*b*, 12*c* to each other may also help to provide a substantially even surface for installing the decorative coverings 14*b*, 14*c*, 14*d* (e.g., where the engagement layers 12*b*, 12*c* include cushioning layers 32 and/or reinforcement layers 30). Engaging adjacent engagement layers 12*b*, 12*c* to each other may take place prior to installing the decorative coverings 14*b*, 14*c*, 14*d*, for example where the engagement layers 12*b*, 12*c* are laid down on the substrate 10 before the decorative coverings 14*b*, 14*c*, 14*d* are applied to the engagement layers 12*b*, 12*c*.

Although the engagement system between the engagement layer 12, 12*a*, 12*b*, 12*c* and the substrate 10 has been described as a hook-and-loop system, other engagement systems may also be used. Example engagement systems may include first and second components that complement each other and form permanent or non-permanent engagement with each other. The first and second components may be substantially similar or different.

Figure 4A:
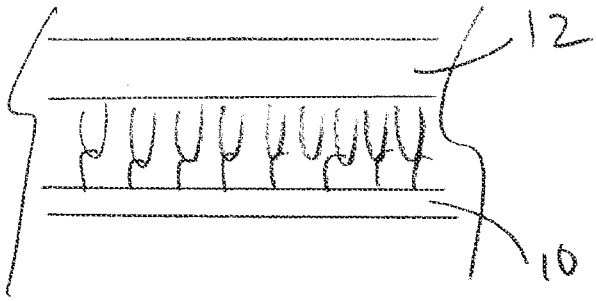
FIGS. 4A-4E illustrate examples of engagement systems suitable for use with an example engagement layer.

FIG. 4A shows an example hook-and-loop engagement system, where the loops may be provided on the engagement layer 12 and the hooks may be provided on the substrate 10.

Figure 4B:
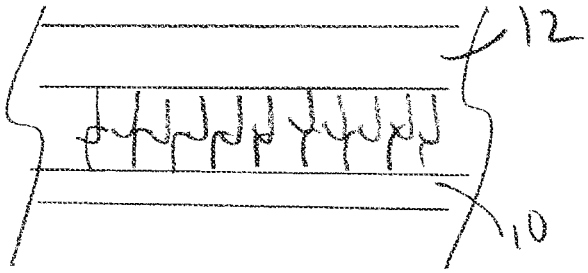

FIG. 4B shows an example hook-and-hook engagement system, where both the engagement layer 12 and the substrate 10 may have hooks, which hook onto each other for a detachable engagement.

Figure 4C:
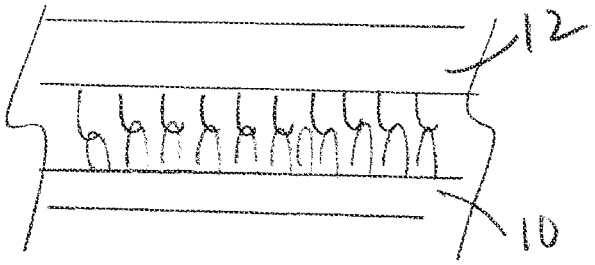

FIG. 4C shows another example hook-and-loop engagement system, where the hooks may be provided on the engagement layer 12 and the loops may be provided on the substrate 10.

Figure 4D:
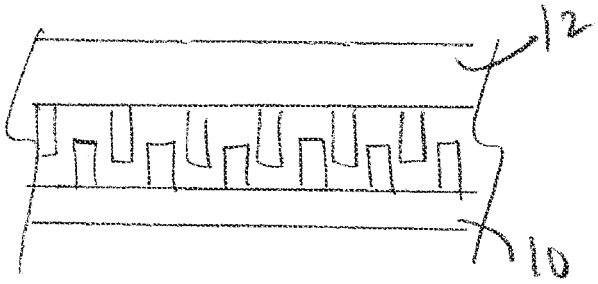

FIG. 4D shows an example interlocking system, where the engagement layer 12 and the substrate 10 may have complementary teeth or protrusions that mesh or interlock with each other. This meshing or interlocking may prevent displacement of the engagement layer parallel to the substrate 10. In some examples, the complementary teeth or protrusions may provide a friction-fit for engaging the engagement layer 12 to the substrate 10. In some examples, the complementary teeth or protrusions may not actually engage the engagement layer 12 to the substrate 10, but only keep the engagement layer 12 from sliding parallel to the substrate 10. The use of grout 28 and/or abutting of other engagement layer(s) 12 and/or walls may prevent the engagement layer 12 from being lifted up along the sides.

Figure 4E:
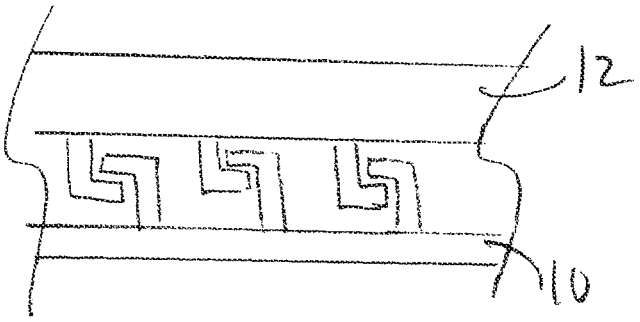

FIG. 4E shows another example interlocking system, where the engagement layer 12 and the substrate 10 may have complementary protrusions that interlock with each other. The protrusions may interlock with each other by sliding the engagement layer 12 parallel to the substrate 10 (e.g., in a tongue-and-groove interlocking system).

Other engagement systems may be used. Although the engagement systems of FIGS. 4A-4E have been described with respect to the engagement layer 12 and the substrate 10, these example engagement systems may also be used for engaging the decorative covering 14 to the engagement layer 12.

The systems and methods disclosed herein may be useful for converting decorative coverings designed for use with permanent attachment systems to be used with non-permanent engagement systems. For example, a decorative covering 14 designed to be directly attached to a base surface using an adhesive (which may be difficult to remove later) may instead be engaged on the covering-receiving side 18 of the engagement layer 12 which in turn may be non-permanently engaged with the substrate 10 supported by the base surface. Thus, future repair or removal of the decorative covering 14 may be facilitated by removing the corresponding engagement layer 12 from the substrate 10, rather than having to remove a direct adherence to the base surface.

The use of an engagement layer 12 that may be separately engagement with any decorative covering 14 may also help to facilitate manufacture of the decorative covering 14, for example by allowing for attachment at the installation site rather than at the manufacturing site. This may also allow the same decorative covering 14 to be used for both conventional permanent attachment directly to a base surface as well as non-permanent attachment using the substrate 10. The need for stocking two versions of the decorative covering 14 may thus be avoided.

The use of an engagement layer 12 may also help to avoid imperfections and/or unevenness of the base surface and/or the substrate 10 from being translated into imperfections and/or unevenness of the decorative covering 14. For example, the engagement layer 12 may provide a cushioning layer 32 or a rigid or reinforcement layer 30 that smoothes out any such imperfections and/or unevenness. This may be useful for reducing or eliminating the preparation of the base surface (e.g., sanding, cleaning, etc.) required before installing the decorative covering 14. The use of the systems and methods disclosed herein may also avoid the concern that the adhesive used to directly attach the decorative covering 14 to the base surface may not be fully cured (e.g., where the decorative covering 14 is an air-impermeable material such as vinyl).

The use of the methods and systems disclosed herein may help to simplify the installation of a decorative covering 14, which may reduce the time and/or expense involved and may allow installation by non-professionals.

The use of the methods and systems disclosed herein may also allow for decorative coverings 14 to be easily installed and easily removed repeatedly, for example for temporary installations.

Examples and ranges here are provided for the purpose of illustration only and are not intended to be limiting. Variations are possible. Where value ranges are described, all values and sub-ranges within the value ranges are also disclosed. Features described in different embodiments may be combined. All documents referenced are hereby incorporated by reference in their entirety.

The invention claimed is:

1. A method for engaging a decorative covering to a non-decorative substrate, the method comprising:

applying an engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system;

applying the decorative covering to the applied engagement layer, the decorative covering having an engagement side for engagement to the covering-receiving side of the engagement layer; and placing the substrate on a base surface, the substrate being free of attachment to the base surface;

wherein at least a portion of at least one of the engagement side of the decorative covering and the covering-receiving side of the engagement layer has a second engagement system for engaging the decorative covering to the engagement layer, and using at least a portion of the perimeter of the engagement layer to bias a perimeter of an adjacent engagement layer, such that the portion of the perimeter of the engagement layer exerts a force against the perimeter of the adjacent engagement layer, thereby holding the assembled engagement layer and the adjacent engagement layer together.

2. A method for engaging a decorative covering to a non-decorative substrate, the method comprising:

applying an engagement layer to the non-decorative substrate, the engagement layer having a covering-receiving side and an opposing substrate-receiving side, at least a portion of the substrate-receiving side having a first component of a first engagement system, the non-decorative substrate having a second component of the first engagement system, the first and second components forming a resilient bond;

applying the decorative covering to the engagement layer, the decorative covering having an engagement side for engagement to the covering-receiving side of the engagement layer;

wherein the decorative covering includes a grouting product along at least a portion of the perimeter of the decorative covering;

and wherein at least a portion of at least one of the engagement side of the decorative covering and the covering-receiving side of the engagement layer has a second engagement system for engaging the decorative covering to the engagement layer; and displacing the engagement layer at least in a direction parallel to the non-decorative substrate, in order to stretch the resilient bond;

wherein a side of the grouting product opposing the decorative covering is pressed against a surface, to maintain the displacement of the engagement layer, wherein the decorative covering is biased against the grouting product by the stretched resilient bond such that the stretched resilient bond experiences tension after assembly.

* * * * *